US005261487A

United States Patent [19]

McLeod et al.

[11] Patent Number: 5,261,487

[45] Date of Patent: Nov. 16, 1993

[54] PACKOFF NIPPLE

[76] Inventors: Roderick D. McLeod, 5104 - 125 Street, Edmonton, Alberta; Albert Roesch, 28 Parsons Close, Red Deer, Alberta, both of Canada

[21] Appl. No.: 909,680

[22] Filed: Jul. 7, 1992

[30] Foreign Application Priority Data

Dec. 6, 1991 [CA] Canada ..... 2057219

[51] Int. Cl.[5] ..... E21B 23/06; E21B 33/128

[52] U.S. Cl. ..... 166/77; 166/96; 166/196; 166/387

[58] Field of Search ..... 166/77, 82, 84, 88, 166/89, 387

[56] References Cited

U.S. PATENT DOCUMENTS

| | | | |
|---|---|---|---|
| 2,610,689 | 8/1946 | Eckel | 166/89 |
| 3,830,304 | 8/1974 | Cummins | 166/77 |
| 4,023,814 | 5/1977 | Pitts | 277/181 |
| 4,111,261 | 9/1978 | Oliver | 166/86 |
| 4,541,490 | 9/1985 | Bigbie et al. | 166/84 |
| 4,601,494 | 7/1986 | McLeod | 285/110 |
| 4,632,183 | 12/1986 | McLeod | 166/77 |
| 4,867,243 | 9/1989 | Garner et al. | 166/379 |
| 4,993,489 | 2/1991 | McLeod | 166/387 X |
| 5,060,723 | 10/1991 | Sutherland et al. | 166/387 X |
| 5,080,174 | 1/1992 | Hynes | 166/387 X |
| 5,103,900 | 4/1992 | McLeod et al. | 166/88 |

FOREIGN PATENT DOCUMENTS

| | | |
|---|---|---|
| 1094945 | 2/1981 | Canada . |
| 1222204 | 5/1987 | Canada . |
| 1267078 | 3/1990 | Canada . |
| 1272684 | 8/1990 | Canada . |

*Primary Examiner*—Ramon S. Britts
*Assistant Examiner*—Frank S. Tsay
*Attorney, Agent, or Firm*—Anthony R. Lambert

[57] ABSTRACT

A packoff nipple for use on the mandrel of a wellhead isolation tool features a two step extrusion sealing arrangement activated by a primary element forcing the expansion of a packing ring to fill voids in the tubing or casing brought about by pipe erosion, corrosion, out of round or off center mandrel conditions. Extremely high pressures are sealed off from the wellhead. The packoff nipple sealing elements are protected from damage when running the nipple through restricted areas in the wellhead and the tubing or casing.

17 Claims, 12 Drawing Sheets

PACKOFF NIPPLE

FIELD OF THE INVENTION

This invention relates to a sealing nipple for use on the mandrel of an isolation tool, which tool is used when performing the services of fracturing and acidizing of oil and gas wells.

BACKGROUND OF THE INVENTION

In the oilfield service industry and specifically in the division known as the wellhead isolation tool service industry, several of the wellhead isolation tools in use are described in: Bullen, A Well Tree Saver, Canadian Patent No. 1,094,945, U.S. Pat. No. 4,241,786, McLeod, an Insertion Drive System for Tree Savers, Canadian Pat. No. 1,222,204, U.S. Pat. No. 4,632,183, Dallas-Garner, Wellhead Isolation Tool and Setting Device and Method of Using Same, Canadian Pat. No. 1,267,078, U.S. Pat. No. 4,867,243, Cummins, (Assigned to Halliburton Co.), a Wellhead Isolation Tool and Method of Use Thereof, U.S. Pat. No. 3,830,304. The purpose of these tools is to insert a mandrel through a wellhead and into the tubing or casing therein to allow the high pressure fluid to be injected and bypass the wellhead configuration. (For this discussion, we will refer only to the tubing although the same sealing systems which will be described have been used to seal in the well casing.) The difference seen in the isolation tools is mainly in the method used to push the mandrel into the wellhead. The end of the mandrel which enters the tubing has a sealing nipple on it that is generally referred to as a nipple, sealing means, packing or elastomer. Such sealing means is mentioned in Bullen, and five such nipples or sealing means which are in common use today in the isolation tool industry are shown in cross section as existing practice in FIGS. 1A to 7A. The various sealing shapes of the elastomers under pressure are shown in FIGS. 1B to 7B.

FIG. 1A shows Pitts, a Tree Saver Packer Cup, U.S. Pat. No. 4,023,814 (Assigned to Dow Chemical Co.). This packer cup has the elastomer 101 bonded at 102 to the nipple body 103. In FIG. 1B the elastomer is shown as a friction fit at 104 in the tubing 105 and is under pressure 106.

FIG. 2A, from Oliver, a Wellhead Isolation Tool, U.S. Pat. No. 4,111,261 (assigned to Halliburton) shows the elastomer 201 bonded at 202 to the nipple body 203. FIG. 2B shows the elastomer expanded by pressure 204 against the wall 205 of the tubing 206. FIG. 3A shows a sealing nipple from the same patent with a moveable primary seal element 301 including an O-ring seal and carrier 302. The primary seal element will move against and expand a packer ring 303. FIG. 3B shows this movement and expansion at 305 and 306 in the tubing 304 due to the pressure 307. The packer ring will collapse to its original shape when pressure is removed.

FIG. 4A shows McLeod, a Nipple Insert, Canada Pat. No. 1,169,766, U.S. Pat. No. 4,601,494, and has the elastomer seal 401 bonded at 402 to the nipple body 403 and the bond protected from the treating pressures by a tapered steel conical insert 404. In FIG. 4B it is shown as a friction fit at 405 in the tubing 406 under pressure 407.

FIG. 5A shows a later type of sealing nipple, from Sutherland-Wenger, a Wellhead Isolation Tool Nipple, Canadian Pat. No. 1,272,684. This sealing nipple is characterized by a protected moveable sealing element 501 which is moved out of the sealing cup 510 by pressure from the well through ports 502. An improvement by the inventors Sutherland-Wenger not described in the existing patent is presented and has the moveable sealing element backed by a split steel ring 503 on a conical seat 504 of the nipple body 505. As shown in FIG. 5B, this split steel ring expands due to the pressure 506 on the moveable sealing element to contact at 507 the inside of the tubing 508 and prevents the sealing element from being extruded up the annulus 509 formed by the nipple body and tubing. The moveable seal element will collapse to the original shape when pressure is removed.

FIG. 6A shows a version of a sealing nipple used by Arrowhead and FIG. 7A a version used by Dow Schlumberger which are somewhat like that described in Oliver (Halliburton), FIG. 3A. They feature two sealing elements noted as the primary sealing element 601, 701 and the packer ring 602, 702. The two sealing nipples shown differ only in the shape of the O-ring seal carrier 603, 703 which is bonded to the primary sealing element. FIGS. 6B and 7B show the primary sealing element, which fits in the tubing 604, 704 by friction, move against the packer ring when the primary sealing element is energized by the well pressure 605, 705, thus sealing off the well pressure at 606, 706 and 607, 707 from the annulus 608, 708. The packer rings will collapse to their original shape when pressure is removed.

These existing nipples all have their own advantages and disadvantages. One of the main sealing problems is caused by the more frequent use of HYDRILL tubing and its clones in oil and gas wells. An example of HYDRILL tubing is shown in cross section generally at 800 in FIG. 8. It is shown threaded into a dognut 801 which has a back pressure plug thread at 802. This tubing has an entrance diameter 803 which is less than the inside major diameter 804 of the rest of the tubing. In order to get a friction fit seal in the major diameter of the tubing, the sealing material must be able to compress enough to pass through the entrance diameter of the tubing and then expand enough to seal the major diameter of the tubing. The sealing elements proposed in Pitts, Oliver (FIG. 3A), Bullen and McLeod (Nipple Insert), rely on a friction fit in the tubing for sealing and they do not perform well in the HYDRILL type of tubing. There is also the chafing and cutting effects on the seals as they are forced through the back pressure threads in the dognut. The Pitts invention is prone to failure at the elastomer to steel bonded junction due to the treating pressures. The Halliburton design FIG. 2A, is also limited by the strength of the rubber bond between the sealing medium and the nipple body. The McLeod nipple, FIG. 4A, has a measure of safety at this bond. It is also of note that in conventional tubing, if the tubing is out of round or corroded in such a way as to leave a depression, there is the possibility that the sealing medium will not seal, or that it will seal only under the initial well pressure and then rupture under the higher pressures of the well servicing. There is also an economic and operational disadvantage to the bonded sealing elements. They must have the sealing medium stripped off and replaced in an appropriate facility when it is damaged. Designs shown in FIGS. 3A, 5A, 6A and 7A have replaceable sealing elements. The Sutherland-Wenger nipple seal element is initially moved into the sealing position by pressure from the well but in the case of a dead well, this is not available. When in the set position, FIG. 5B, there is a physical limitation on the expansion of the steel ring without it yielding and taking a permanent set. When this happens, it prevents the nipple assembly from being easily withdrawn from the wellhead. There is also a gap in the split ring into which the sealing medium is extruded, and this keeps the split ring from contracting to its original shape, also preventing the nipple assembly from being easily withdrawn from the wellhead.

The Oliver (assigned to Halliburton) nipple of FIG. 3A and the Arrowhead FIG. 6A and Dow-Schlumberger FIG. 7A are prone to failure in the primary seal element bond to the O ring seal carrier as noted in the Dow Schlumberger manual, and there are limitations to the expansion and sealing capabilities of the packer ring, which in case of failure of the primary seal element, must seal both on the nipple body and in the tubing.

All of the mentioned sealing nipples have a sealing capability only while the seal elements are kept under pressure.

SUMMARY OF THE INVENTION

The invention comprises a sealing nipple for use on a wellhead isolation tool which will seal the high pressure fluids or gases being pumped through the tool and into the tubing from egress into the low pressure rated parts of the wellhead.

In one aspect, the invention comprises an improvement to existing sealing nipples in that it has on the periphery of the major diameter of its elastomeric primary seal a collapsible sealing lip which will expand and create an initial seal. The concentric sealing lip will preferably collapse inward to allow entrance into narrow passages in the wellhead and tubing without damage during installation in the wellhead.

In another aspect there is provided an elastomeric packer ring with a bonded structural steel insert which will prevent the packer ring from distortion when under pressure and when the sealing nipple and mandrel are in an off center position.

In a still further aspect there is provided a double shoulder and land configuration for the elastomeric packer ring to ride up on and compress or extrude into the annulus formed by the nipple body and the tubing.

In a still further aspect there is provided an elastomeric packer ring which will remain in place by friction forces when pressure on it has been released.

There is therefore provided in one aspect of the invention a packoff nipple comprising:

a sealing nipple body having an axis and an upper portion;

an elastomeric packer ring disposed about and movable axially on the upper portion of the sealing nipple body;

a primary seal disposed about and movable axially on the sealing nipple body below the elastomeric packer ring; and the elastomeric packer ring including a rigid sleeve disposed about the sealing nipple body internally of the elastomeric packer ring and firmly attached to the elastomeric packer ring.

Such a packoff nipple preferably includes a shoulder member attached to the upper portion of the sealing nipple body, the shoulder member having a lower end, the lower end of the shoulder member having an external diameter sufficiently smaller than the diameter of the tubing for which the packoff nipple is intended to create a gap between the shoulder member and the tubing, so that when the packoff nipple is installed in the tubing and the well is under well-servicing pressures the elastomeric packer ring extrudes into the gap.

The lower end of the shoulder member preferably includes a first angular shoulder, a second angular shoulder and a land between the first and second shoulders, and the length of the first and second angular shoulders and the land are selected in relation to the size of the elastomeric packer ring so that upon extrusion of the elastomeric packer ring into the gap under well fracturing or acidizing pressures, the elastomeric packer ring extrudes past the first angular shoulder and the land, to the second angular shoulder.

The packoff nipple preferably includes the primary seal having a lip extending circumferentially around the primary seal, the lip having a downward facing portion, such that well pressure acting on the downward facing portion tends to push the primary seal axially upward more than radially inward.

In another aspect the invention provides a device for sealing a portion of a tube from an expected pressure from one end of the tube, the one end of the tube defining a downward end and the tube having an inside diameter, the device comprising:

a cylindrical body having an axis and an upper portion;

a first annular elastomeric sealing element disposed about and movable axially on the upper portion of the cylindrical body;

a first angular shoulder at the upper portion of the cylindrical body, the first angular shoulder terminating in a land having a first diameter;

a second angular shoulder spaced from the first angular shoulder upward of the land and terminating at a surface having a second diameter;

means for urging the first annular elastomeric sealing element upward in response to the expected pressure; and the first annular elastomeric sealing element having sufficient mass to extrude onto the land and to the angular second shoulder under the expected pressure.

Preferably the means for urging the first annular elastomeric sealing element upward is a second annular elastomeric sealing element disposed about and movable axially on the cylindrical body below the first annular elastomeric sealing element;

the second annular elastomeric sealing element having a lip extending circumferentially around the second annular elastomeric sealing element, the lip being engageable with the tube under the expected pressure to form a seal.

The annular elastomeric sealing elements preferably include rigid sleeves internally bonded to them, and the shoulders and the land are formed on the lower end of a shoulder sub.

In a still further aspect of the invention, there is provided a packoff nipple for use in a well subject to pressure, the packoff nipple comprising:

a sealing nipple body having an axis and an upper portion;

an elastomeric packer ring disposed about and movable axially on the upper portion of the sealing nipple body;

a primary seal disposed about and movable axially on the sealing nipple body below the elastomeric packer ring; and the primary seal having a lip extending circumferentially around the primary seal, the lip having a downward facing portion, such that well pressure acting on the downward facing portion tends to push the primary seal upward more than inward.

The primary seal preferably includes a steel sleeve bonded internally to the primary seal, and the lip being on a portion of the primary seal protruding downward of the sleeve. Also, the inner diameter of the primary seal is preferably larger than the inner diameter of the sleeve.

BRIEF DESCRIPTION OF THE DRAWINGS

There will now be described preferred embodiments of the invention by way of example with reference to the drawings in which.

DETAILED DESCRIPTION OF A PREFERRED EMBODIMENT

Figure 1A:
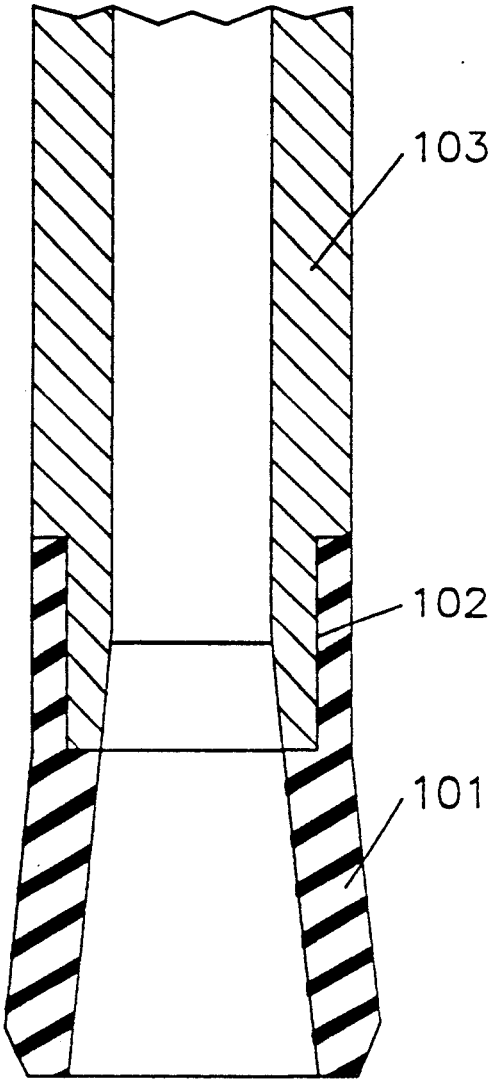
Prior Art Fig. 1A
FIGS. 1A, 1B, 2A, 2B, 3A, 3B, 4A, 4B, 5A, 5B, 6A, 6B, 7A, and 7B are prior art showing different types of wellhead packoff nipple structures. Also
Figure 1B:
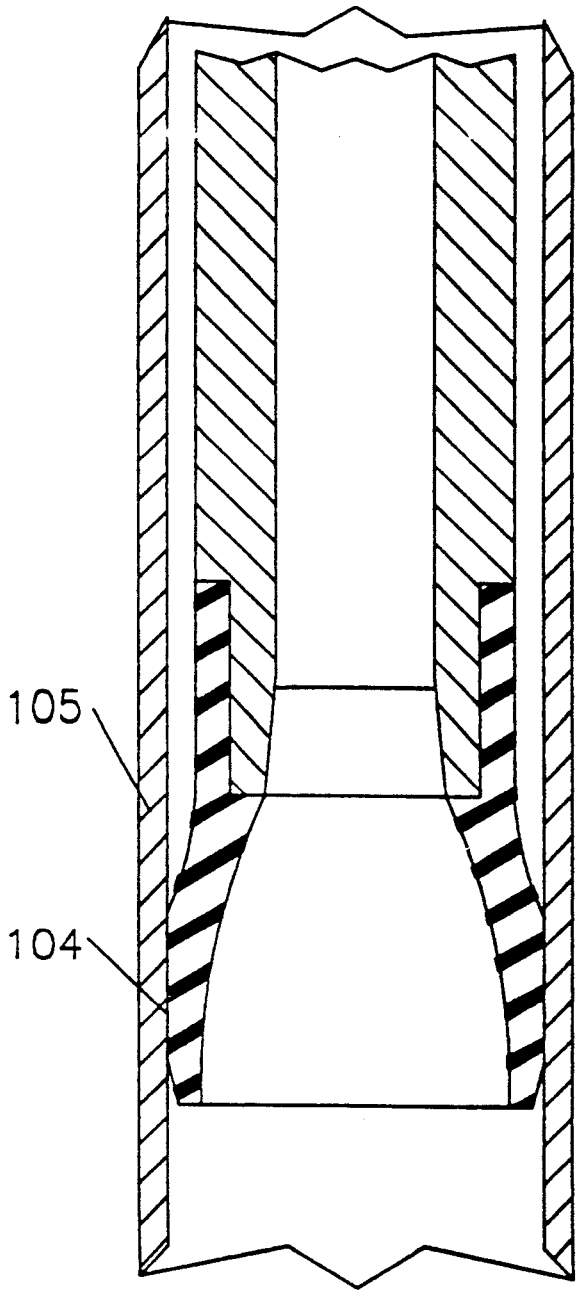
Prior Art Fig. 1B
Figure 2A:
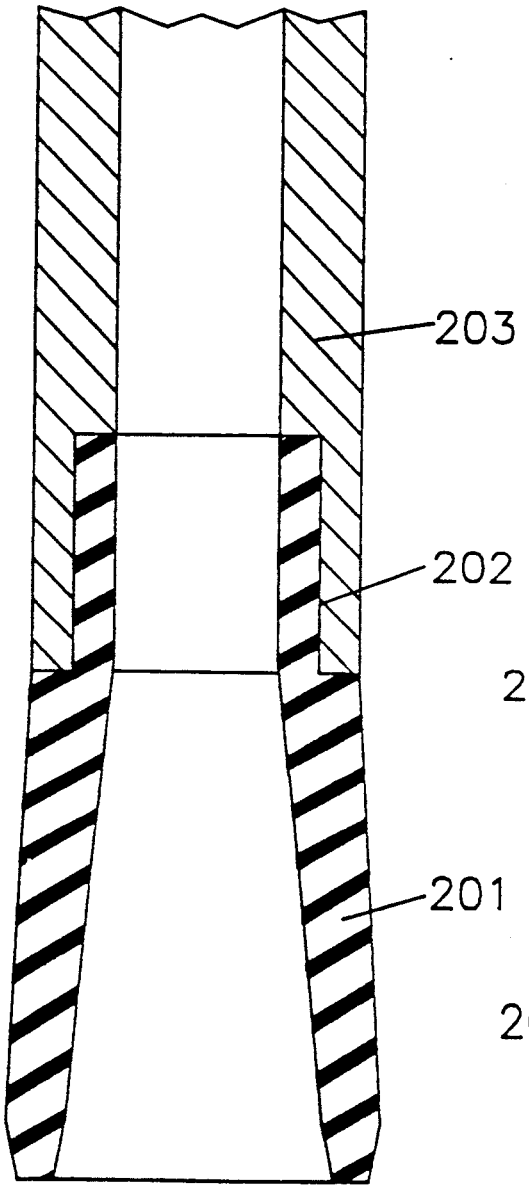
Prior Art Fig. 2A
Figure 2B:
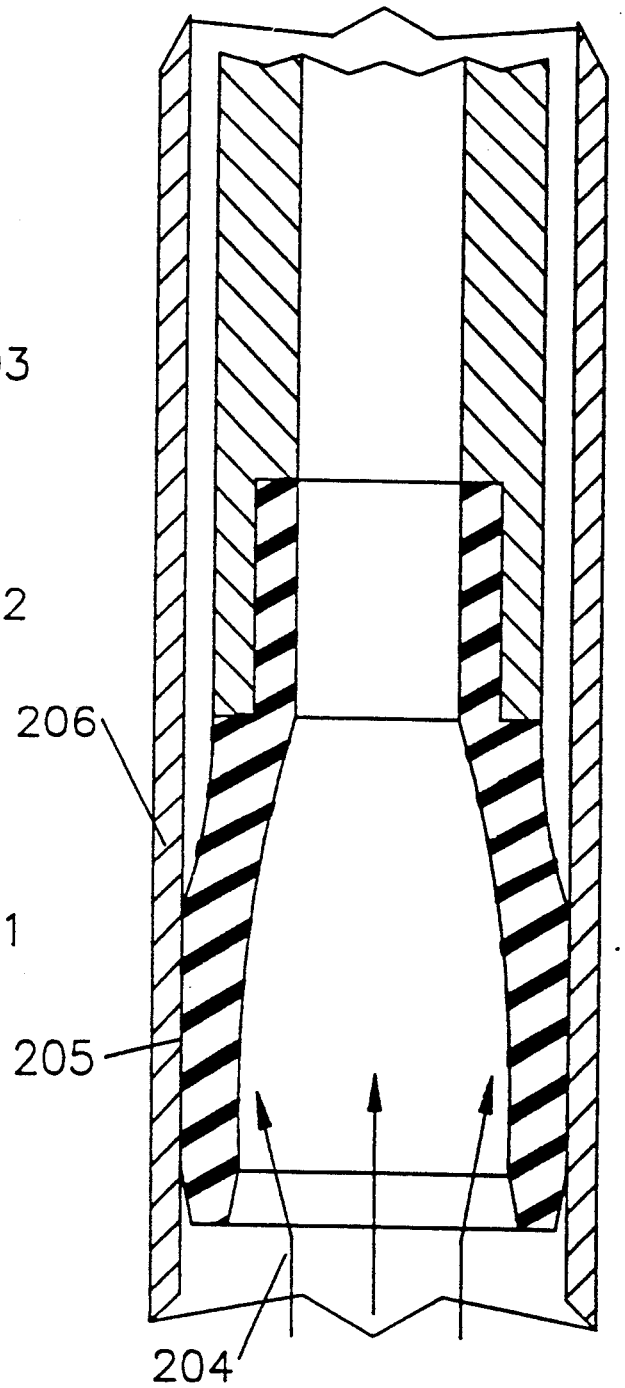
Prior Art Fig. 2B
Figure 3A:
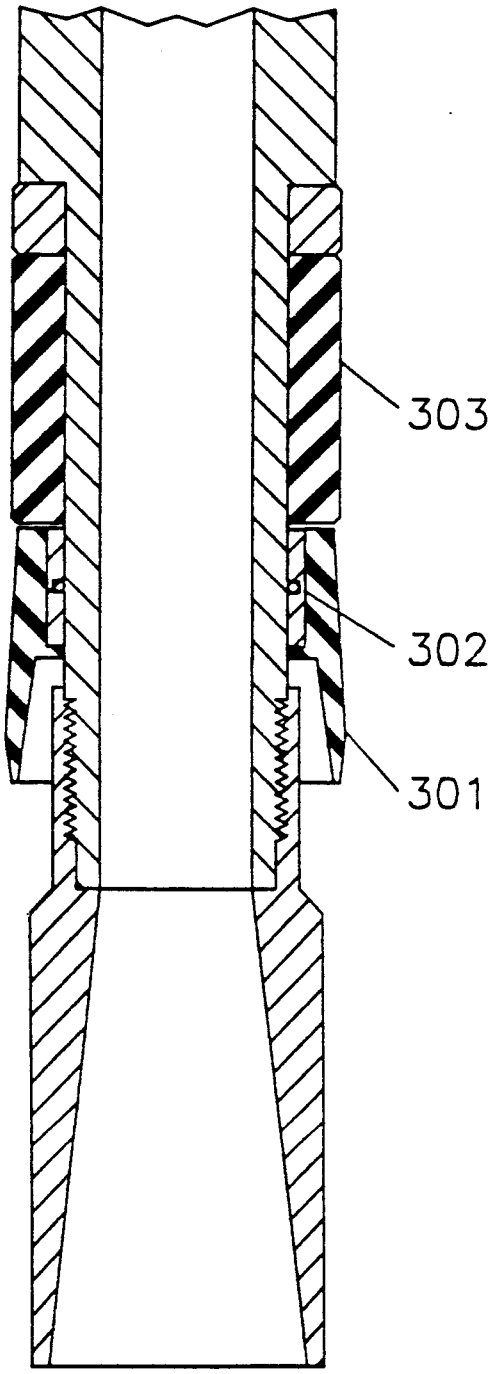
Prior Art Fig. 3A
Figure 3B:
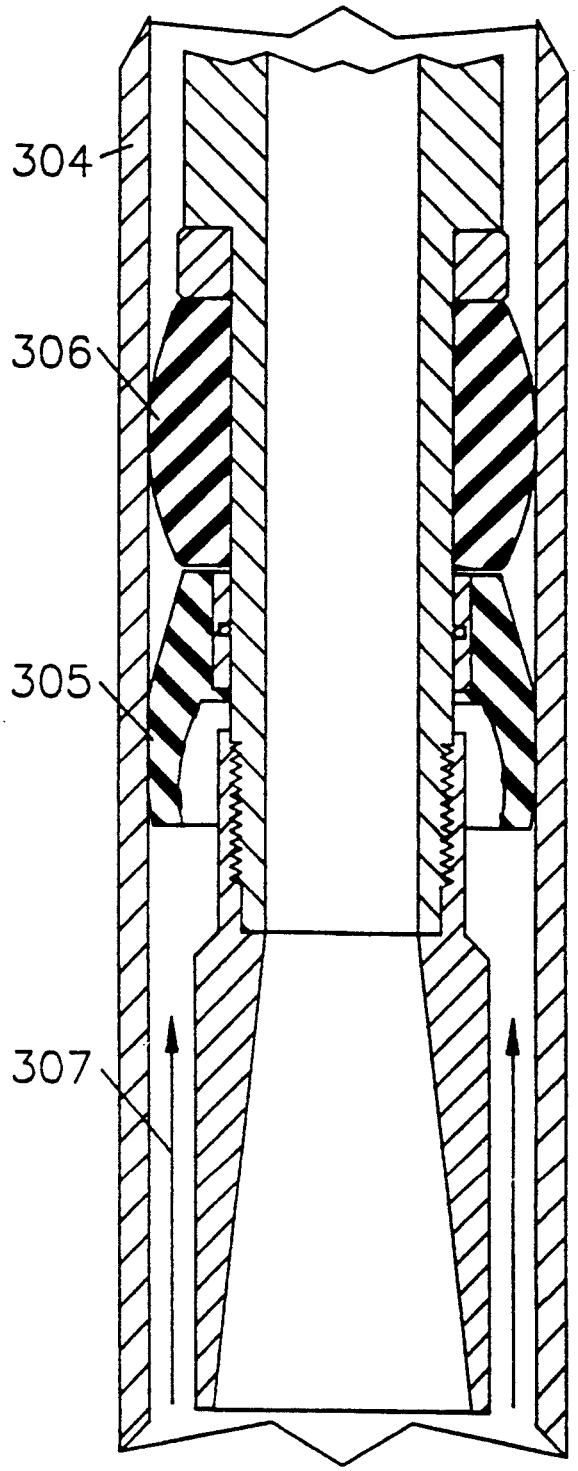
Prior Art Fig. 3B
Figure 4A:
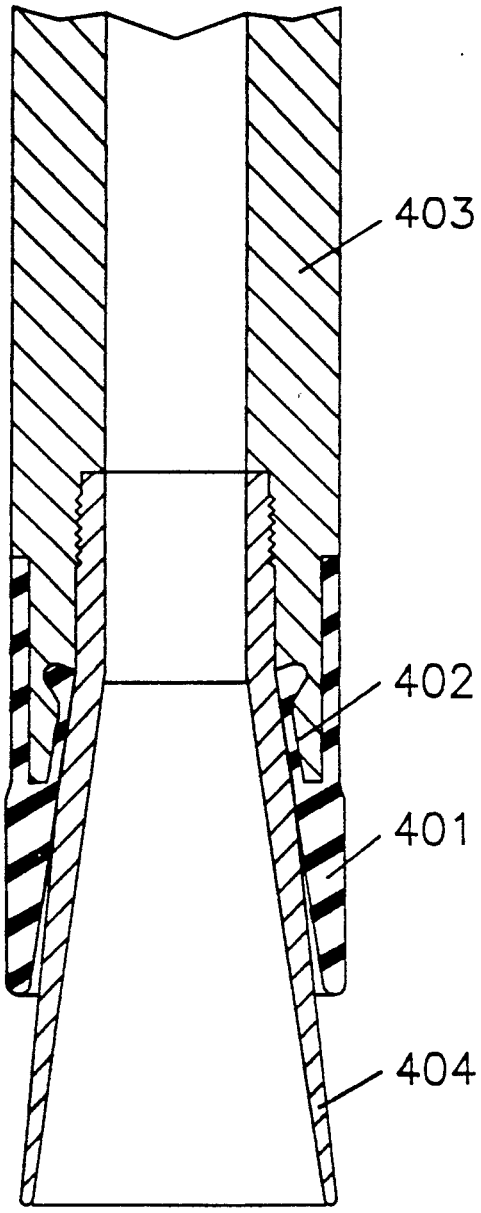
Prior Art Fig. 4A
Figure 4B:
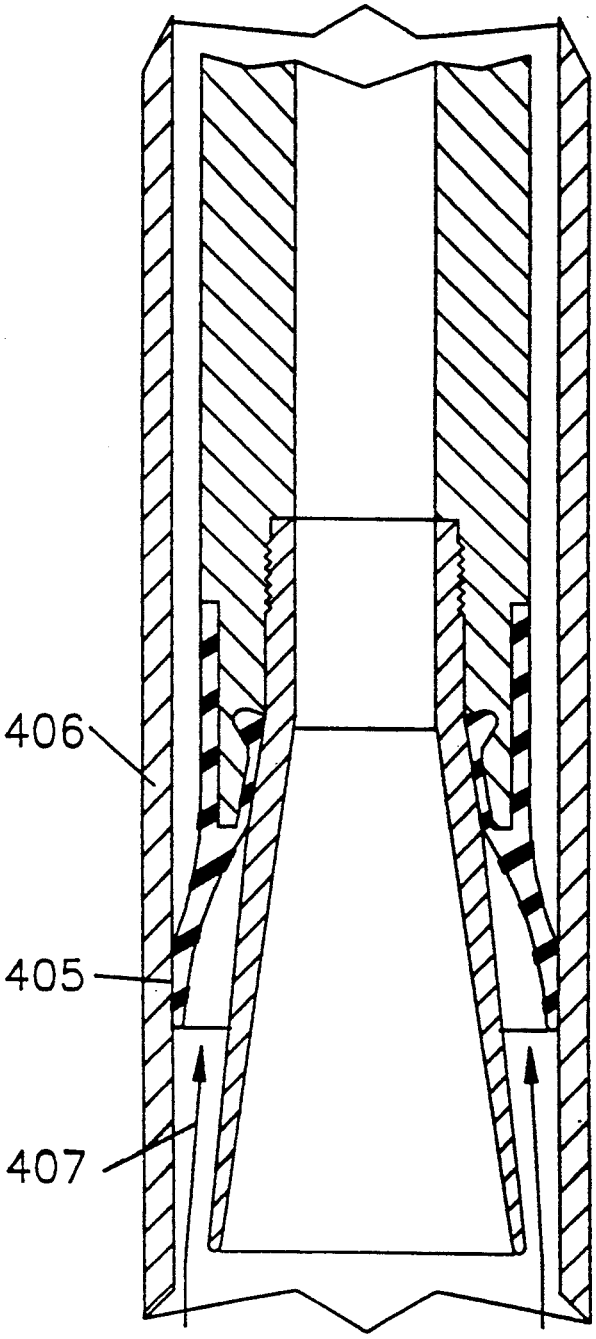
Prior Art Fig. 4B
Figure 5A:
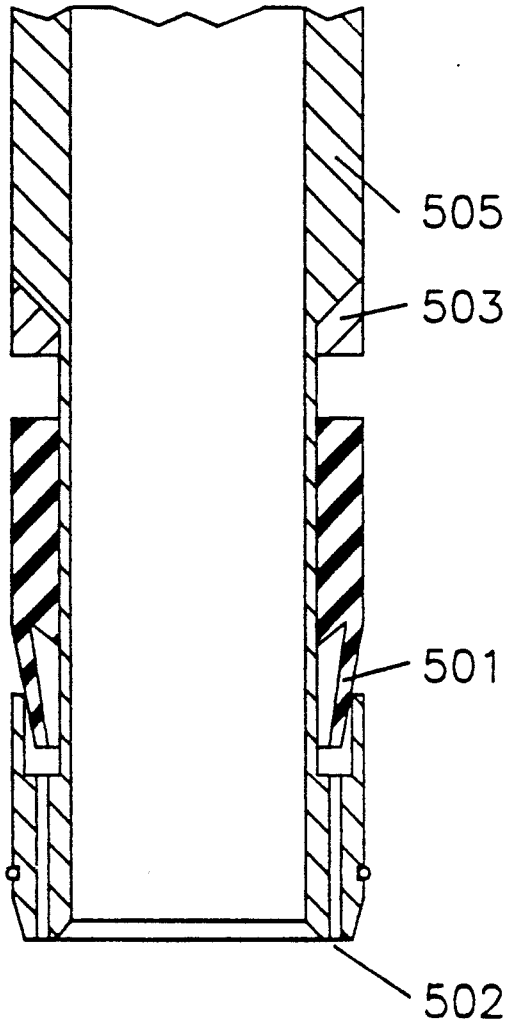
Prior Art Fig. 5A
Figure 5B:
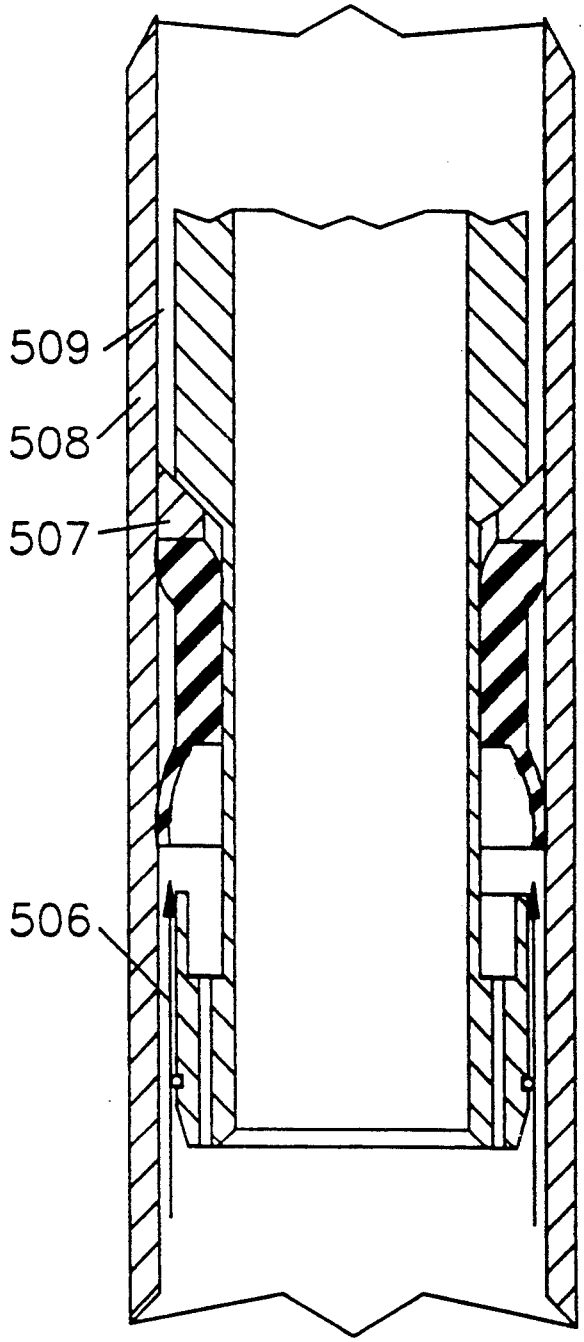
Prior Art Fig. 5B
Figure 6A:
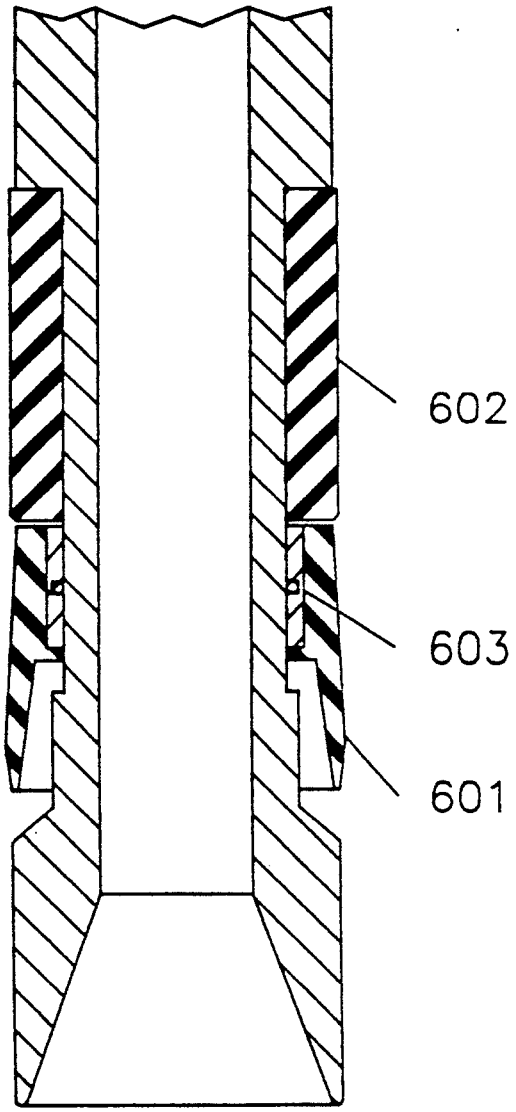
Prior Art Fig. 6A
Figure 6B:
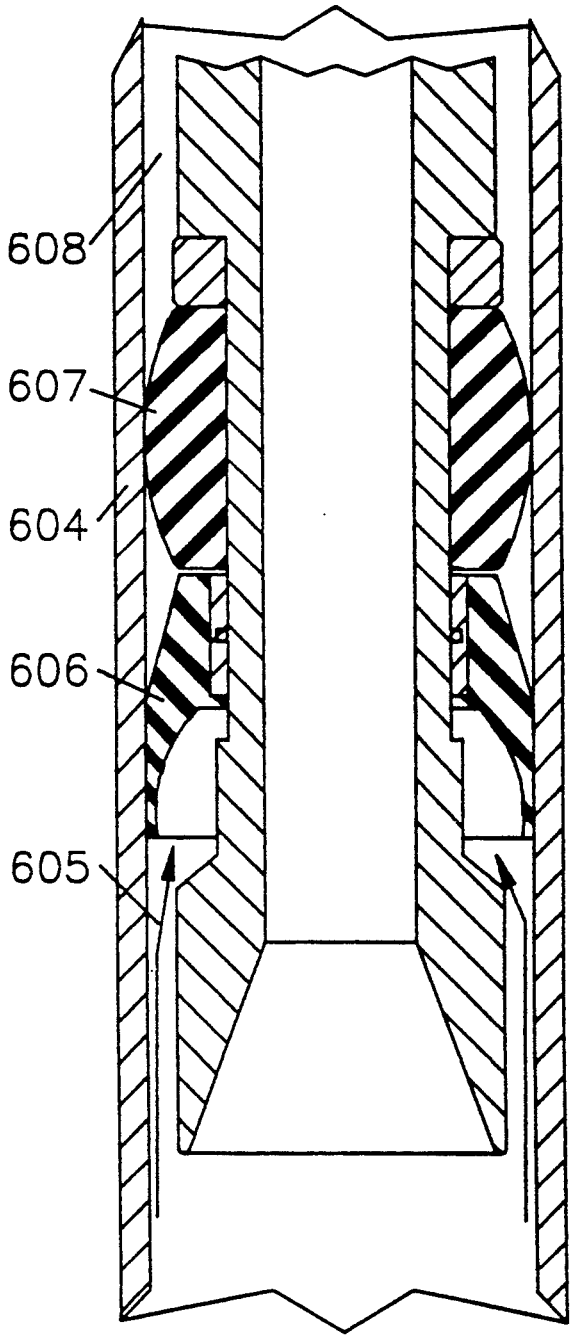
Prior Art Fig. 6B
Figure 7A:
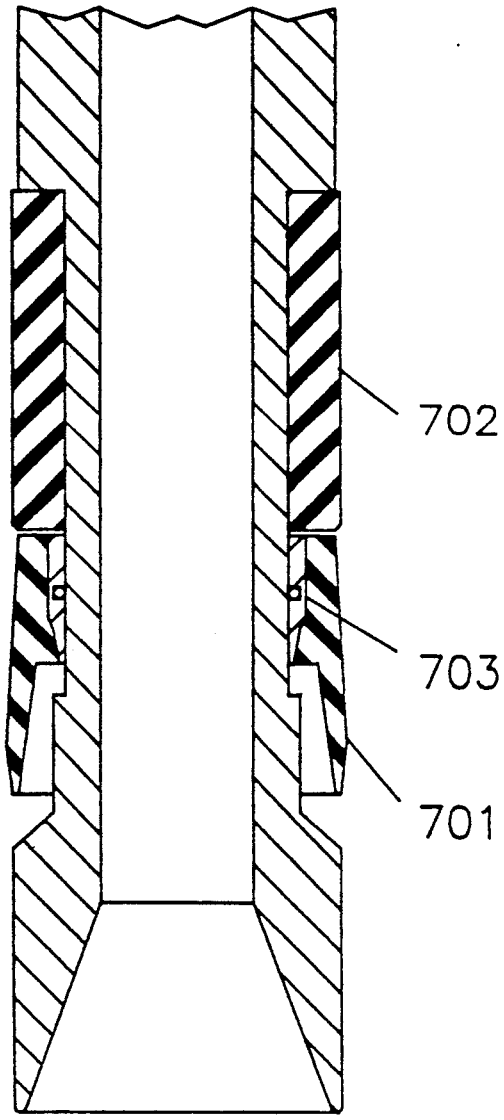
Prior Art Fig. 7A
Figure 7B:
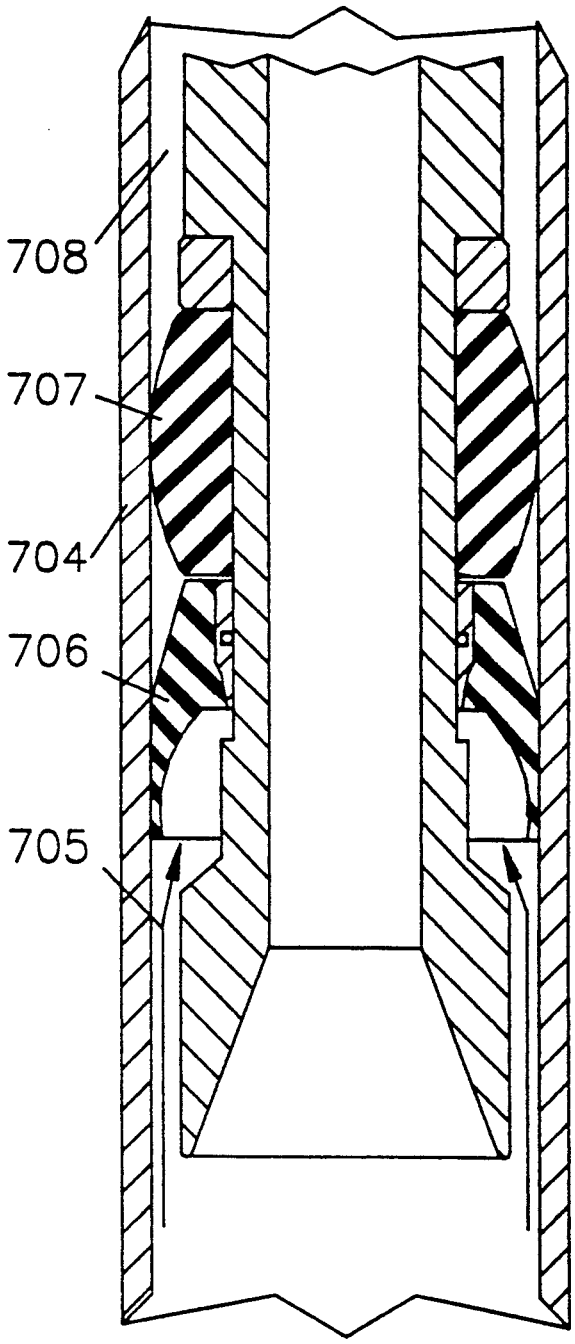
Prior Art Fig. 7B
Figure 8:
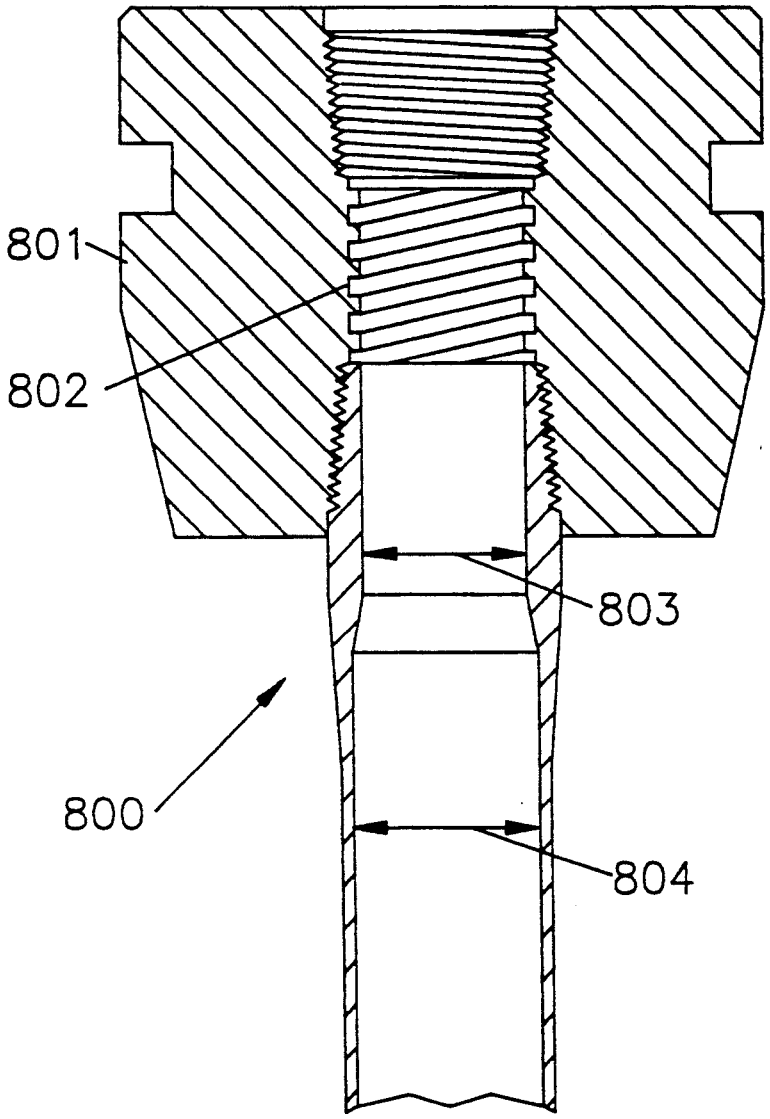
FIG. 8 shows a commonly used "HYDRILL" tubing structure.
Figure 9:
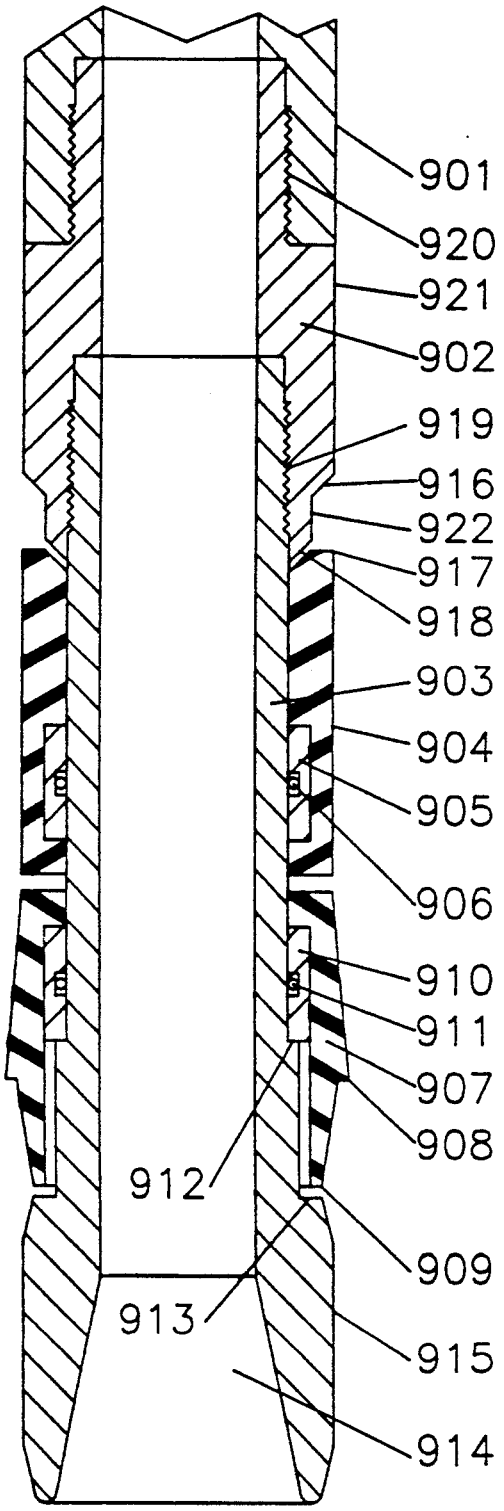
FIG. 9 shows an apparatus according to the invention in side view cross section.
Figure 13:
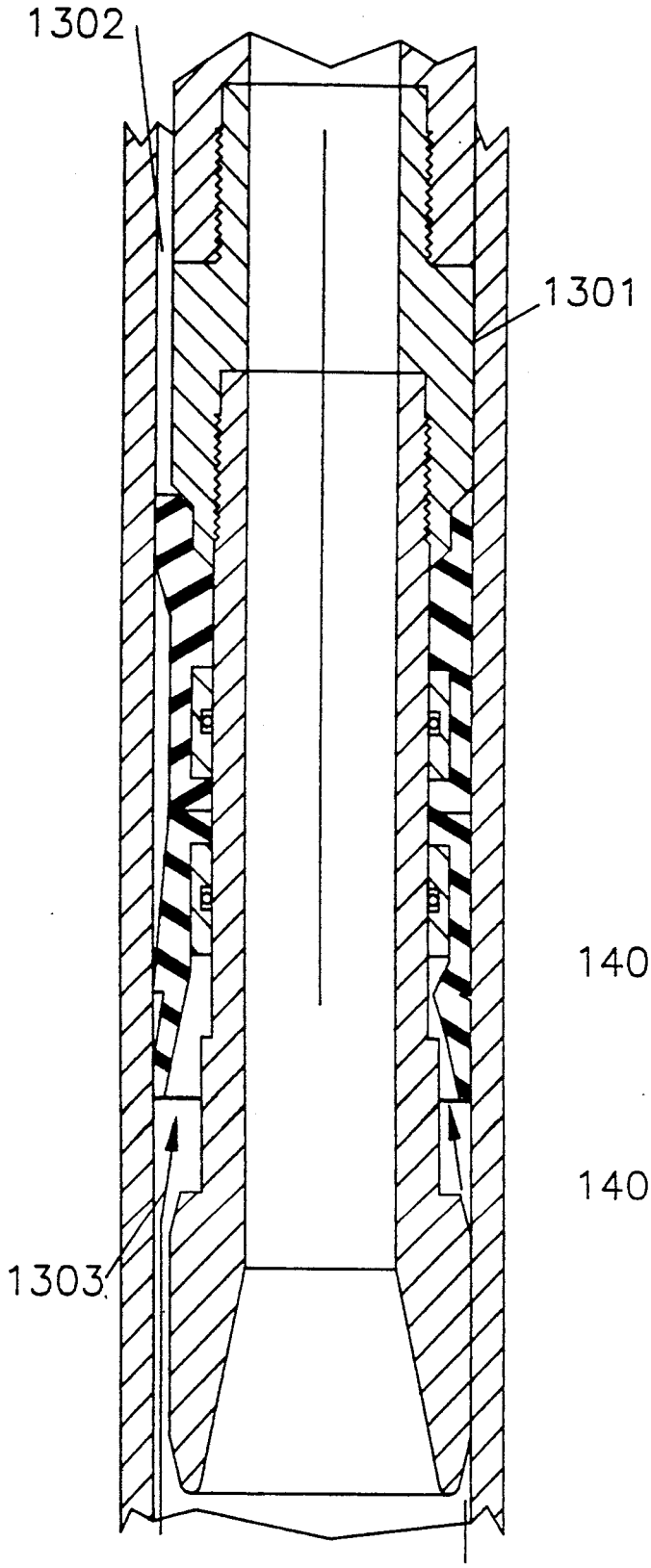
FIG. 13 shows in cross section the position of the elastomeric primary sealing element and the elastomeric packer ring in the case of an off center mandrel condition.
Figure 14:
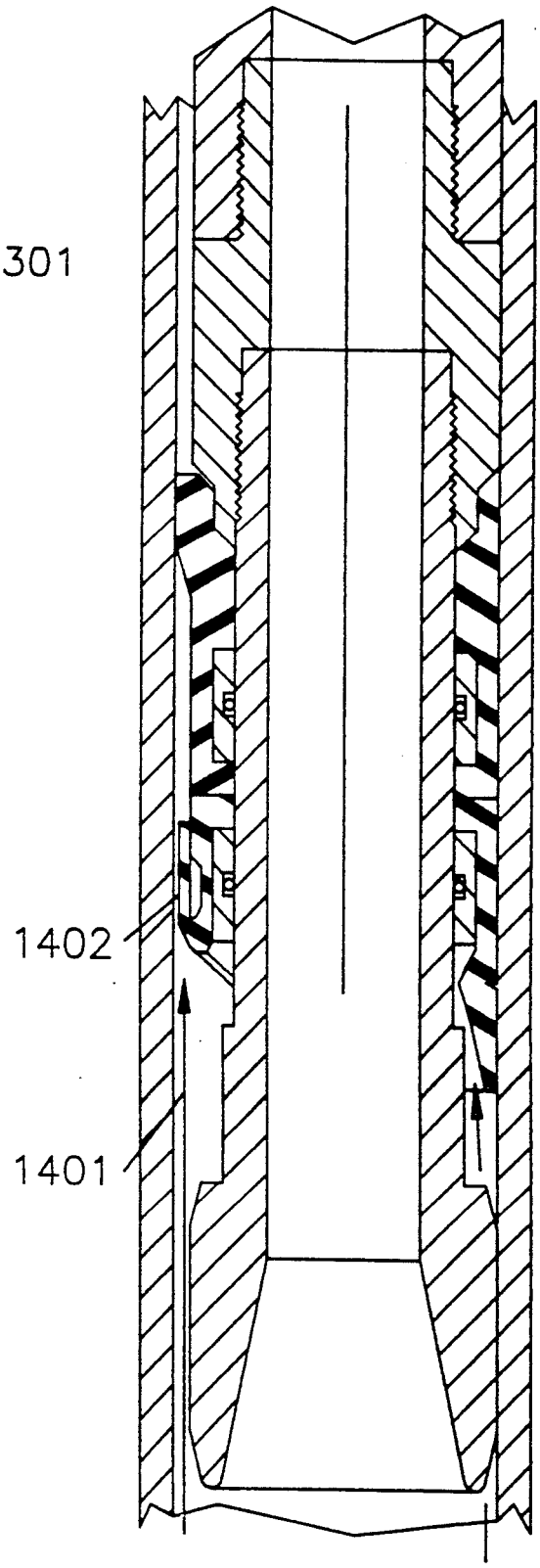
FIG. 14 shows in cross section the position of the elastomeric primary sealing element and the elastomeric packer ring in the case of an off center mandrel condition where the elastomeric primary sealing element has failed due to high pressure.

Referring to FIG. 9, all of the items noted are circular in section with a central axis (shown in FIGS. 13 and 14). Throughout this patent disclosure and in particular in the claims, downward means the direction down the well as if the packoff nipple were installed at a well, and in each Figure means towards the bottom edge of the drawing sheet.

The complete sealing nipple assembly 900 is shown attached at 920 to the wellhead isolation tool mandrel 901. At the base of the tool mandrel, there is attached a shoulder sub 902. The shoulder sub has an outside diameter 921 and its lower end includes an angled first shoulder 918, an angled second shoulder 916 and a land 922 between the two shoulders. The land has a first diameter, and terminates in the second shoulder 916. The second shoulder 916 terminates in the outer surface of the shoulder sub 902, which has a second diameter smaller than the inside diameter of the tubing 1102 for which the packoff nipple is intended (see FIG. 11). The shoulder sub is attached at 919 to the upper portion of a cylindrical nipple body 903. An elastomeric packer ring 904 is movable axially up and down on the upper portion of the nipple body 903. Inside the elastomeric packer ring 904 is firmly attached preferably by bonding a rigid steel ring or sleeve 905 which is internally grooved for an O ring 906. The O ring creates a moveable seal between the steel ring and the nipple body. By the use of suitable bonding materials, the steel sleeve can be made essentially integral with the elastomer so that the elastomer will tear before the bond is broken.

Also sliding on the nipple body axially up and down, and below the elastomeric packer ring, is an elastomeric primary seal 907 which has as part of its construction a sealing lip 908 and a forward lip 909. A rigid steel ring or sleeve 910 is firmly attached, preferably by bonding, internally to the primary seal. The rigid sleeve 910 is internally grooved for an O ring 911. This O ring creates a moveable seal between the steel ring and the nipple body. The sealing lip 908 should be located on a portion of the primary seal protruding downward of the sleeve 910 and the primary seal is recessed below the sleeve 910.

There are also shown as part of the lower portion of the nipple body, a stop shoulder 912 having an outer diameter greater than the inner diameter of the sleeve 910 so that the sleeve is prevented from movement past the shoulder 912. The shoulder 912 assists in preventing the primary seal 907 from moving onto the nipple bullnose 915 at the lowermost extremity of the packoff nipple. Below the stop shoulder is a protecting shoulder 913 which also prevents the primary seal 907 from moving onto the bullnose 915. The lower end of the nipple body includes a conical outlet 914 formed within the bullnose 915.

Each of the elastomeric packer ring 904 and the primary seal 907 may be characterized as annular elastomeric sealing elements. For some applications, the sleeve 905 and elastomeric packer ring 904 may terminate downward at the same point (that is with no elastomeric material below the sleeve), but it is desirable to have some elastomeric material on the downward side of the sleeve to help prevent pressure from tearing the sleeve from the elastomer.

The lip 908 should not be made too large otherwise upward pressure on the lip during entry of the packoff nipple into tubing may activate the packer ring and make it difficult to insert the packoff nipple into the wellhead.

Figure 10:
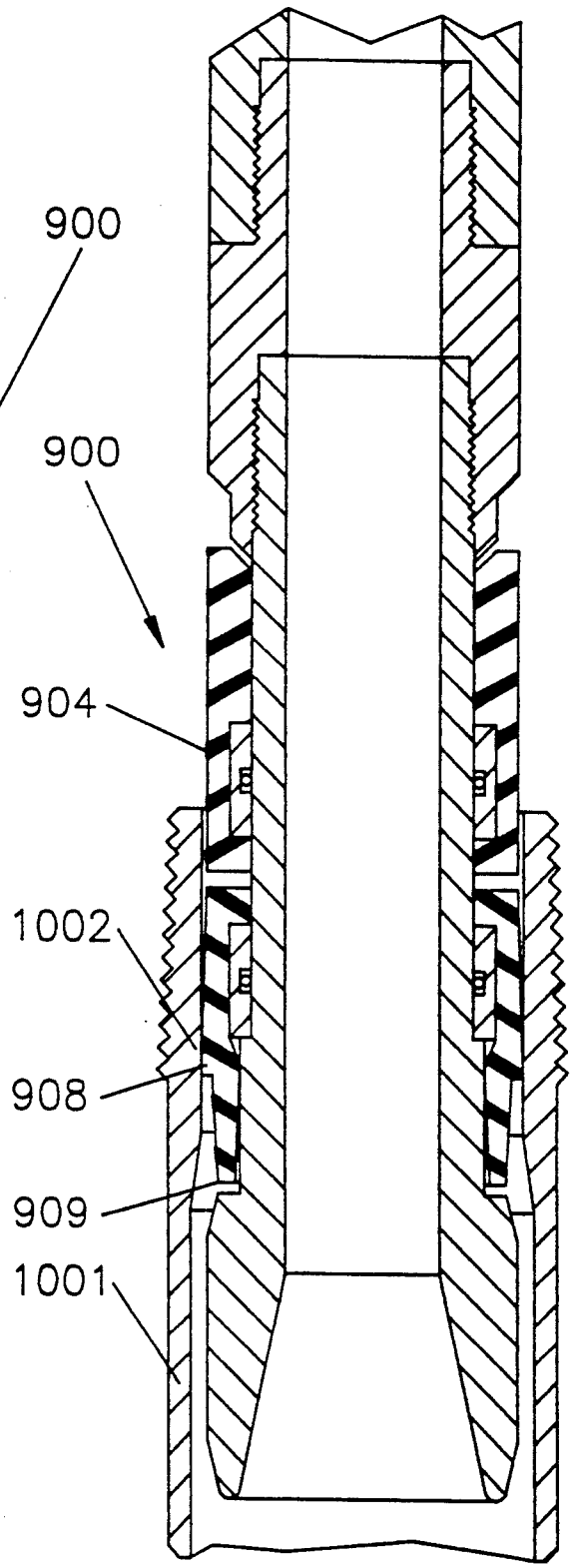
FIG. 10 shows in cross section the protection of the elastomeric sealing elements when the invention is inserted through a restricted entry tube.

Referring to FIG. 10, the complete sealing nipple at 900 is shown in a length of restricted opening tubing 1001. The elastomeric primary seal 908 has been forced to conform to the inside diameter of the restriction at 1002, and the forward lip 909 has been compressed inward onto the nipple body. The outside diameter of the elastomeric packer ring 904 is smaller than the diameter of the shoulder sub and bullnose which are sized to pass through the restricted diameter, and this packer ring is not affected by the restriction.

Figure 11:
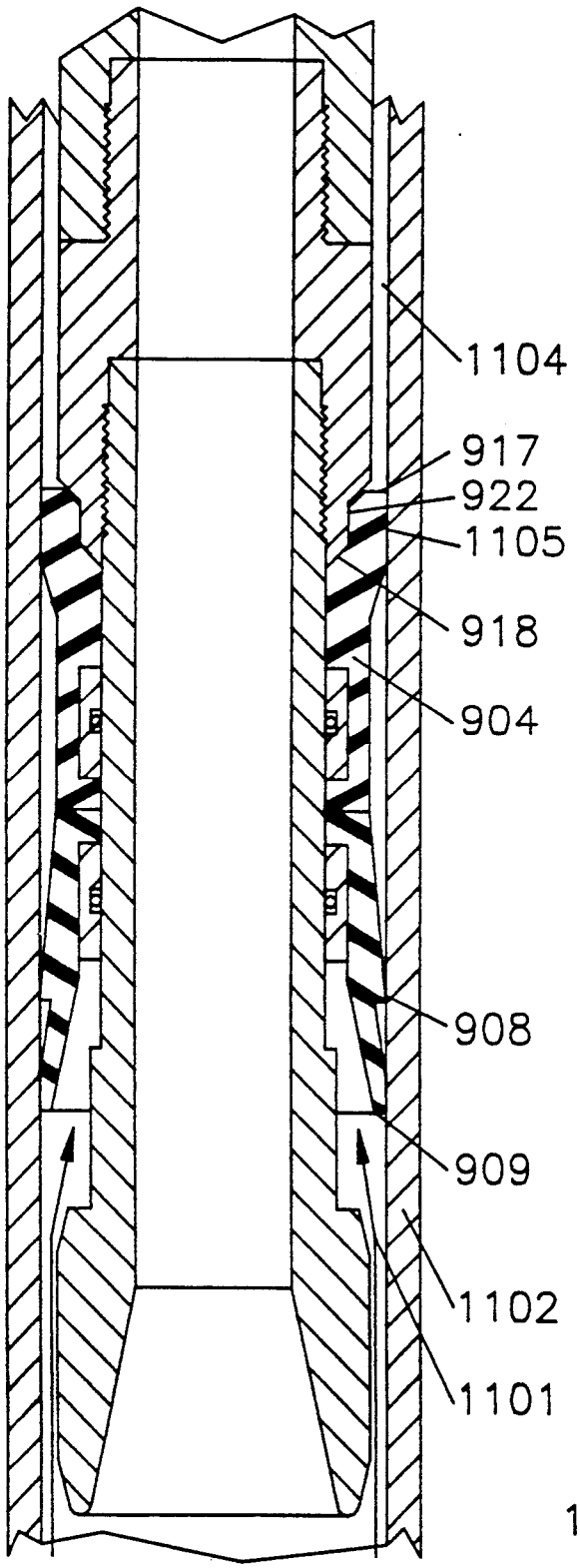
FIG. 11 shows in cross section the position taken by the elastomeric primary sealing element and the elastomeric packer ring under moderate pressure.

Referring to FIG. 11, the pressure from the well 1101 on the sealing lip of the elastomeric primary seal has pushed upward on the elastomeric primary seal, deformed the elastomeric primary seal and caused the forward lip of the elastomeric primary seal to conform to the inside diameter 1105 of the tubing 1102, and thus seal the annulus 1104 from the well pressure. If this well pressure is high enough, it will more or less simultaneously move the elastomeric primary seal in the direction of the elastomeric packer ring. As shown, the elastomeric packer ring will extrude up the angled first shoulder of the shoulder sub and compress against the internal diameter of the tubing 1105, and the land 922 of the shoulder sub thus creating a second seal against migration of pressure from the tubing up to the annulus.

The seal thus created by the packer ring becomes both an extrusion fit seal and a friction seal and will not reform into its original shape unless moved to its original position due to a rise in pressure in the annulus over that in the tubing or movement of the sealing nipple in an upward direction.

Figure 12:
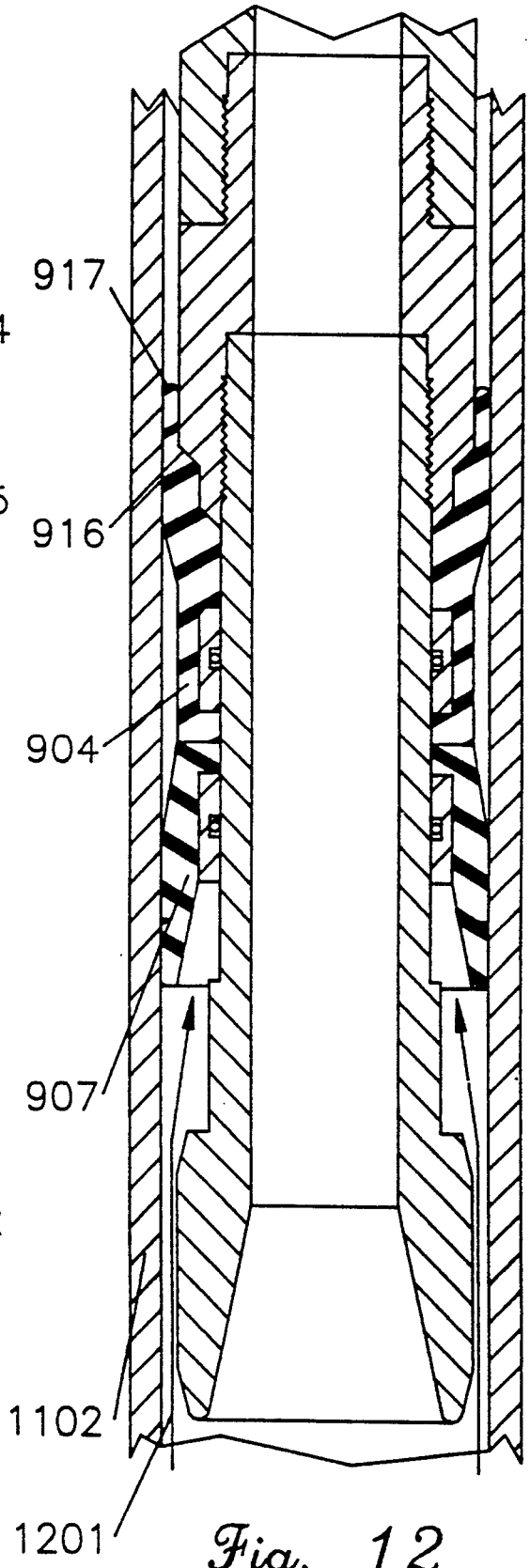
FIG. 12 shows in cross section the position taken by the elastomeric primary sealing element and the elastomeric packer ring under high pressure.

Referring to FIG. 12, the pressure 1201 is the high pressure in the tubing from the fracturing or acidizing of the well. The elastomeric primary seal 907 has been compressed under the well pressure acting on the forward lip 909 and the lateral lip 908 to completely conform to the inside diameter of the tubing and has further moved against the elastomeric packer ring 904, causing the sealing shoulder 917 of the elastomeric packer ring to be extruded up the angled second shoulder of the shoulder sub and over the shoulder sub outside diameter, thus sealing in an extrusive and frictional compressive way against the inside diameter of the tubing and the outside diameter 921 of the shoulder sub. Evidently, the packer ring must have sufficient mass to extrude into the gap between the land and the tubing, and preferably on into the gap between the outer surface of the shoulder sub and the tubing.

Through experimentation it has been found that the use of two angled shoulders with the first land and second outside diameter of the shoulder sub is optimum. Higher multiples of angled shoulders do not improve the sealing characteristics of the assembly. A single shoulder is not preferred since the elastomeric sealing element tends to fail to remain in place after the pressure is removed. The shoulders must have a gradated increase in diameter, such as be angled or slanted, to allow the elastomer to move over them.

Referring to FIG. 13, the sealing nipple is depicted in tubing where due to the wellhead being slightly crooked, which to some extent nearly all wellheads are, the sealing nipple is pushed off to one side represented by the close fit at 1301 and the gap at 1302. The well pressure 1303 has moved the elastomeric primary seal against the elastomeric packer ring which has been extruded into sealing against the inside diameter of the tubing. The use of the steel ring as part of the construction of the elastomeric packer ring has prevented the packer ring from being deformed and moved in a non concentric way.

Referring to FIG. 14, in the offset circumstance shown in FIG. 13, the high pressure in the tubing 1401 due to well servicing is shown to have deformed the elastomeric primary seal at 1402 into failure and as in practice, the elastomeric packer ring is holding the pressure from migrating into the annulus.

The packoff nipple has been described as using a shoulder sub for attachment to the mandrel. It is possible to form the shoulder-land-shoulder sequence on the lower end of the mandrel but this is not preferred due to the necessity of the replacing the mandrel as it wears and due to the use of different diameters in the various tubings and casings used in wells. For the purposes of the claims, the word member has been used to describe the possibility that the shoulder-land-shoulder sequence could be on the lower end of the mandrel or the lower end of the shoulder sub.

The preferred configuration of the lip 908 is as shown with an annular face extending radially outward and oriented in the down hole direction. The face makes an approximately right angled edge with the outer surface of the primary seal above the lip. In this manner, pressure from down the well pushing upward on the face of the lip 908 forces the primary seal 907 upward. As it pushes up against the elastomeric ring 904, the primary seal 907 thickens to form a seal against the tubing.

The term rigid as use in this patent disclosure means that the element will not deform substantially under typical well servicing pressures. Thus an element made of steel will be rigid.

The term land means a cylindrical surface having a diameter distinct from the diameter of adjoining surfaces, and in particular, the adjoining surface on one side of the land has a lower diameter than that of the land, and the adjoining surface on the other side of the land has a greater diameter than that of the land.

The elastomers used for the packer ring and the primary seal are readily commercially available, and it is preferable that the packer ring have a greater durometer value than the primary seal. Thus the harder packer ring will be able to withstand greater wear while the softer primary seal will be able to flex when the nipple is inserted into tubing. For example, durometer values of 80 for the primary seal and 95 for the elastomeric packer ring may be used for smaller sized packoff nipples.

The placement of the outer lip 908 on the primary seal below the rigid sleeve 910, the reduced diameter of the primary seal below the rigid sleeve, and the softness of the primary seal, all facilitate the inward bend of the lip 908 as the packoff nipple is moved into position in a wellhead. This helps prevent wear on the primary seal.

Figure 15:
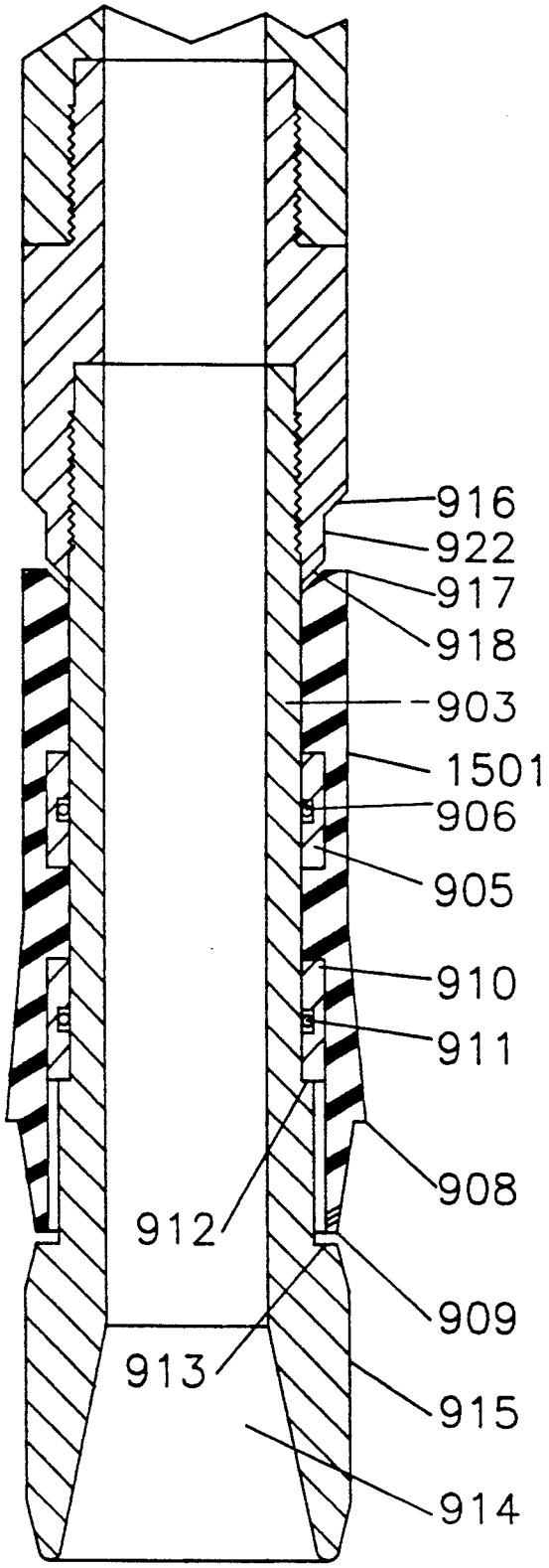
FIG. 15 shows in cross-section an embodiment of the invention in which the primary seal is integral with the elastomeric packer ring.

The lower end of the elastomeric packer ring may be constructed to resist upward pressure with means for urging the packer ring upward in response to the expected pressure such as a lip 908 shown in FIG. 15 on the lower end of the elastomeric packer ring. Such a lip should be constructed to flex upon entry of the packoff nipple into the tube for which it is intended, but to resist upward pressure. In that case, upward pressure on the lip would tend to move the elastomeric packer ring upward axially along the packoff nipple, and the primary seal may be formed integrally with the elastomeric packer ring as shown in FIG. 15. This, however, is not preferred. In part this is because it is desirable for the two elastomeric sealing elements to be of different hardness, and partly it is because the primary seal tends to wear more than the packer ring, and the use of the two components means that only the primary seal need be replaced when it wears.

A person skilled in the art could make immaterial modifications to the invention described and claimed in this patent without departing from the essence of the invention.

We claim:

1. A packoff nipple comprising:

a sealing nipple body having an axis and an upper portion;

an elastomeric packer ring disposed about and movable axially on the upper portion of the sealing nipple body;

a primary seal disposed about and movable axially on the sealing nipple body below the elastomeric packer ring; and the elastomeric packer ring including a rigid sleeve disposed about the sealing nipple body internally of the elastomeric packer ring and firmly attached to the elastomeric packer ring.

2. The packoff nipple of claim 1 further including:

a shoulder member attached to the upper portion of the sealing nipple body, the shoulder member having a lower end, the lower end of the shoulder member having an external diameter sufficiently smaller than the diameter of the tubing for which the packoff nipple is intended to create a gap between the shoulder member and the tubing, so that when the packoff nipple is installed in the tubing and the well is under well-servicing pressures the elastomeric packer ring extrudes into the gap.

3. The packoff nipple of claim 2 in which the lower end of the shoulder member includes a first angular shoulder, a second angular shoulder and a land between the first and second shoulders, and the length of the first and second angular shoulders and the land are selected in relation to the size of the elastomeric packer ring so that upon extrusion of the elastomeric packer ring into the gap under well fracturing or acidizing pressures, the elastomeric packer ring extrudes past the first angular shoulder and the land, to the second angular shoulder.

4. The packoff nipple of claim 3 in which the land has a diameter approximately half the diameter of the shoulder member immediately above the second angular shoulder.

5. The packoff nipple of claim 1 further including:

the primary seal having a lip extending circumferentially around the primary seal, the lip having a downward facing portion, such that well pressure acting on the downward facing portion tends to push the primary seal axially upward more than radially inward.

6. A device for sealing a portion of a tube from an expected pressure from one end of the tube, the one end of the tube defining a downward end and the tube having an inside diameter, the device comprising:

a cylindrical body having an axis and an upper portion;

a first annular elastomeric sealing element disposed about and movable axially on the upper portion of the cylindrical body;

a first angular shoulder at the upper portion of the cylindrical body, the first angular shoulder terminating in a land having a first diameter;

a second angular shoulder spaced from the first angular shoulder upward of the land and terminating at a surface having a second diameter;

means for urging the first annular elastomeric sealing element upward in response to the expected pressure; and the annular elastomeric sealing element having sufficient mass to extrude onto the land and to the angular second shoulder under the expected pressure.

7. The device of claim 6 in which:

the means for urging the packer ring upward is a second annular elastomeric sealing element disposed about and movable axially on the cylindrical body below the first annular elastomeric sealing element;

the second annular elastomeric sealing element having a lip extending circumferentially and radially outward around the second annular elastomeric sealing element, the lip being engageable with the tube under the expected pressure to form a seal.

8. The device of claim 7 in which the first annular elastomeric sealing element includes a rigid portion disposed about the cylindrical body internally of the first annular elastomeric sealing element.

9. The device of claim 8 in which the rigid portion is a rigid sleeve firmly attached to the first annular elastomeric sealing element.

10. The device of claim 9 in which the second annular elastomeric sealing element includes a rigid sleeve disposed about the cylindrical body internally of the second annular elastomeric sealing element and bonded to the second annular elastomeric sealing element.

11. The device of claim 9 further including a member threaded onto the upper portion of the cylindrical body, the member having a lower end, and the first angular shoulder, the land and the second angular shoulder being formed on the lower end of the member.

12. The device of claim 11 in which the cylindrical body is a sealing nipple, the first annular elastomeric sealing element is a packer ring, the second annular elastomeric sealing element is a primary seal and the member is a sub for attachment to a mandrel.

13. A packoff nipple for use in a well subject to pressure, the packoff nipple comprising:

a sealing nipple body having an axis and an upper portion;

an elastomeric packer ring disposed about and movable axially on the upper portion of the sealing nipple body;

a primary seal disposed about and movable axially on the sealing nipple body below the elastomeric packer ring; and the primary seal having a lip extending circumferentially around the primary seal, the lip having a downward facing portion, such that well pressure acting on the downward facing portion tends to push the primary seal upward more than inward.

14. The packoff nipple of claim 13 in which the primary seal includes a first rigid sleeve disposed about the sealing nipple body internally of the primary seal, the first rigid sleeve being firmly attached to the primary seal, and the lip being on a portion of the primary seal protruding downward of the first rigid sleeve.

15. The packoff nipple of claim 14 in which the packer ring includes a second rigid sleeve disposed about the sealing nipple body internally of the packer ring, the second rigid sleeve being firmly attached to the packer ring.

16. The packoff nipple of claim 15 in which the primary seal has an inner diameter below the first rigid sleeve that is larger than the inner diameter of the first rigid sleeve.

17. The packoff nipple of claim 16 in which the primary seal is made of a softer material than the packer ring.

* * * * *